US007615126B2

(12) United States Patent
Okada et al.

(10) Patent No.: US 7,615,126 B2
(45) Date of Patent: Nov. 10, 2009

(54) HIGH STRENGTH HOT ROLLED STEEL PLATE EXCELLENT IN ENLARGEABILITY AND DUCTILITY AND METHOD FOR PRODUCING THEREOF

(75) Inventors: Hiroyuki Okada, Tokai (JP); Toshimitsu Aso, Tokai (JP); Riki Okamoto, Tokai (JP)

(73) Assignee: Nippon Steel Corporation, Tokyo-to (JP)

( * ) Notice: Subject to any disclaimer, the term of this patent is extended or adjusted under 35 U.S.C. 154(b) by 103 days.

(21) Appl. No.: 10/433,403

(22) PCT Filed: Dec. 7, 2001

(86) PCT No.: PCT/JP01/10739

§ 371 (c)(1),
(2), (4) Date: Jun. 3, 2003

(87) PCT Pub. No.: WO02/46486

PCT Pub. Date: Jun. 13, 2002

(65) Prior Publication Data

US 2004/0035508 A1 Feb. 26, 2004

(30) Foreign Application Priority Data

Dec. 7, 2000 (JP) ..... 2000-372460
Dec. 7, 2000 (JP) ..... 2000-372461
Dec. 7, 2000 (JP) ..... 2000-372462

(51) Int. Cl.
*C21D 8/02* (2006.01)
*C22C 38/14* (2006.01)

(52) U.S. Cl. ..... 148/602; 148/320; 148/331; 420/126

(58) Field of Classification Search ..... 148/602, 148/331, 320; 420/126
See application file for complete search history.

(56) References Cited

U.S. PATENT DOCUMENTS

2002/0036035 A1* 3/2002 Kashima et al. ..... 148/602

FOREIGN PATENT DOCUMENTS

JP 3-180426 A 8/1991

(Continued)

OTHER PUBLICATIONS

Machine-english translation of Japanese patent 06-293910 dated Oct. 21, 1994.*

(Continued)

*Primary Examiner*—Roy King
*Assistant Examiner*—Jessee R. Roe
(74) *Attorney, Agent, or Firm*—Birch, Stewart, Kolasch & Birch, LLP

(57) ABSTRACT

High strength, hot rolled steel plate providing high level of bore expandability and high level of ductility. Also, method of manufacturing same. In first aspect, steel plate comprises steel having, by mass, C:0.01-0.15%; Si:0.30-2.00%; Mn:0.50-3.00%; P≦0.03%; S≦0.005%; Ti:0.01-0.50%; and/or Ni:0.01-0.05%, with balance Fe and unavoidable impurities. In this steel, ≧80% of all grains have ratio of minor axis to major axis of ≧0.1. This steel plate has steel structure comprising ≧80% ferrite and balance bainite. In second aspect, steel plate has above composition, and ferrite-bainite duplex steel structure in which proportion of ferrite having grain diameter ≦2 μm is ≧80%. In third aspect, steel plate has above composition. wherein contents of C, Si, Mn, Ti, and Nb satisfy requirement represented by formula: $115 \leqq (917-480[C\ \%]+100[Si\ \%]-100[Mn\ \%])-(790\times([Ti\ \%]+[Nb\ \%]/2)^{0.05}) \leqq 235$. This steel plate has steel structure comprising ≧80% ferrite and balance bainite.

10 Claims, 3 Drawing Sheets

FOREIGN PATENT DOCUMENTS

| | | | | |
|---|---|---|---|---|
| JP | 4-088125 | A | | 3/1992 |
| JP | 4-246127 | A | | 9/1992 |
| JP | 6-172924 | A | | 6/1994 |
| JP | 6-200351 | A | | 7/1994 |
| JP | 6-279920 | A | | 10/1994 |
| JP | 6-293910 | A | | 10/1994 |
| JP | 7-011382 | A | | 1/1995 |
| JP | 08-199291 | | * | 8/1996 |
| JP | 8-199291 | A | | 8/1996 |
| JP | 08-325644 | | * | 12/1996 |
| JP | 09-049026 | | * | 2/1997 |
| JP | 9-137249 | A | * | 5/1997 |
| JP | 10-30149 | A | | 2/1998 |
| JP | 10-53837 | A | | 2/1998 |
| JP | 10-219387 | A | | 8/1998 |
| JP | 2000-297349 | A | | 10/2000 |

OTHER PUBLICATIONS

Heat Treater's Guide: Practices and Procedures for Irons and Steels, "Steel quenching Technology" ASM International 1995.*

Kashima et al., Zairyou to Process, vol. 12, No. 6, Sep. 1, 1999.

Kashima et al., Tetsu to Hagane, vol. 67, No. 3, Mar. 1, 2001.

Shunichi Hashimoto et al.; "Development of Nb Added Ferrite-Bainite Steels and their Automotive Application"; Sae Conference International Congress and Exposition, XX, XX; XP001183549; 1982; pp. 1166-1174.

Shun-ichi Hashimoto et al.; "Effect of Microstructure on Mechanical Properties of C-Mn High Strength Hot Rolled Sheet Steel"; Transactions of the Iron and Steel Institute of Japan, Tokyo, JP, vol. 26, No. 11; XP009037124; 1986; pp. 985-992.

* cited by examiner

HIGH STRENGTH HOT ROLLED STEEL PLATE EXCELLENT IN ENLARGEABILITY AND DUCTILITY AND METHOD FOR PRODUCING THEREOF

This application is the national phase under 35 U.S.C. § 371 of PCT International Application No. PCT/JP01/10739 which has an International filing date of Dec. 7, 2001, which designated the United States of America.

BACKGROUND OF THE INVENTION

1. Technical Field

The present invention relates to high strength hot rolled steel plates which are intended for use, for example, in automobile under-carriage components mainly produced by pressing, have a thickness of about 1.0 to 6.0 mm, have a strength of not less than 690 N/mm$^2$, and possess excellent bore expandability and ductility, and a process for producing the same.

2. Background Art

In recent years, environmental problems posed by automobiles have lead to an increase in needs for a reduction in weight of car bodies and a reduction in cost by one-piece molding of components, for improving fuel consumption. To meet these needs, the development of high strength hot rolled steel plates possessing excellent press workability has been forwarded. Well-known conventional high strength hot rolled steel plates for such working include those having a composite structure, such as a ferrite-martensite structure or a ferrite-bainite structure, and those having a substantially single-phase structure composed mainly of bainite or ferrite.

In the ferrite-martensite structure, however, cracking occurs as a result of the formation of microvoids around martensite from an early stage of deformation, and, thus, the ferrite-martensite structure suffers from a problem of poor bore expandability. This renders steel plates having a ferrite-martensite structure unsuitable for use in applications, such as under-carriage components, where a high level of bore expandability is required.

In high strength hot rolled steel plates, it is known that bore expandability and ductility are likely to be contradictory to each other. Specifically, reducing the difference in hardness between ferrite and bainite is one means for improving the bore expandability in the ferrite-bainite structure. In this case, however, matching the hardness to that of hard bainite results in significantly deteriorated ductility, while matching the hardness to that of soft ferrite results in unsatisfactory strength. For compensation for the lack of strength, a large amount of precipitates should be dispersed to strengthen the steel plate. As a result, the ductility is lowered. Japanese Patent Laid-Open Nos. 88125/1992 and 180426/1991 disclose steel plates having a structure composed mainly of bainite. Due to the nature of the structure composed mainly of bainite, however, the amount of the soft ferrite phase is so small that the ductility is poor, although the bore expandability is excellent. Japanese Patent Laid-Open Nos. 172924/1994 and 11382/1995 disclose steel plates having a structure composed mainly of ferrite. These steel plates possess excellent bore expandability. Since, however, hard carbides are precipitated for ensuring strength, here again, the ductility is poor.

Japanese Patent Laid-Open No. 200351/1994 discloses a steel plate having a ferrite-bainite structure which possesses excellent bore expandability and ductility, and Japanese Patent Laid-Open No. 293910/1994 discloses a production process of a steel plate having a combination of good bore expandability with good ductility wherein two-stage cooling is adopted to regulate the proportion of ferrite. However, for example, a further reduction in weight of automobiles and increased complexity of components have led to a demand for a higher level of bore expandability and a higher level of ductility, and a high level of workability and a high level of strength, which cannot be satisfied by the above conventional techniques, are required of steel plates and sheets.

SUMMARY OF THE INVENTION

The present invention has been made with a view to solving the above problems of the prior art, and it is an object of the present invention to provide a high strength hot rolled steel plate, which can prevent a deterioration in bore expandability and ductility involved in an increase in strength to not less than 690 N/mm$^2$ and, despite high strength, possesses a high level of bore expandability and a high level of ductility, and a process for producing the steel plate.

As described above, in high strength hot rolled steel plates, it is well known that bore expandability and ductility are likely to be contradictory to each other. The present inventors have made extensive and intensive studies with a view to attaining the above object of the present invention and, as a result, have found that spheroidizing grains in the ferrite-bainite steel as much as possible can improve the ductility without sacrificing the bore expandability. This had led to the completion of the first aspect of the present invention. That is, in the first aspect of the present invention, the above object of the present invention has been attained by drawing attention, in a ferrite-bainite steel, to ferrite for enhancing the ductility and to precipitates of TiC and/or NbC for ensuring the strength, satisfactorily spheroidizing ferrite grains to improve the ductility without sacrificing the bore expandability, and then forming precipitates to ensure the strength.

Thus, according to a first aspect of the present invention, there is provided a high strength hot rolled steel plate having excellent bore expandability and ductility, comprising a steel comprising, by mass, 0.01 to 0.15% of carbon; 0.30 to 2.00% of silicon; 0.50 to 3.00% of manganese; phosphorus ≦0.03%; sulfur ≦0.005%; 0.01 to 0.50% of titanium and/or 0.01 to 0.05% of niobium; and the balance consisting of iron and unavoidable impurities, not less than 80% of all grains being accounted for by grains having a ratio (ds/dl) of minor axis (ds) to major axis (dl) of not less than 0.1, said steel plate having a steel structure comprising not less than 80% of ferrite and the balance consisting of bainite, the steel plate having a strength of not less than 690 N/mm$^2$.

The present inventors have further found that, in a ferrite-bainite steel, maximizing the proportion of ferrite grains having a given or larger grain diameter can improve the ductility without sacrificing the bore expandability. This has led to the completion of the second aspect of the present invention. That is, in the second aspect of the present invention, the object of the present invention has been attained by drawing attention, in a ferrite-bainite steel, to ferrite for enhancing the ductility and to precipitates of TiC and/or NbC for ensuring the strength, satisfactorily growing ferrite grains to improve the ductility without sacrificing the bore expandability and then producing precipitates to ensure the strength.

Thus, according to the second aspect of the present invention, there is provided a high strength hot rolled steel plate having excellent bore expandability and ductility, comprising, by mass, 0.01 to 0.15% of carbon; 0.30 to 2.00% of silicon; 0.50 to 3.00% of manganese; phosphorus ≦0.03%; sulfur ≦0.005%; 0.01 to 0.50% of titanium and/or 0.01 to 0.05% of niobium; and the balance consisting of iron and unavoidable impurities, said steel plate having a ferrite-bainite duplex steel structure, in which the proportion of ferrite having a grain diameter of not less than 2 μm is not less than 80%, said steel plate having a strength of not less than 690 $N/mm^2$.

Furthermore, the present inventors have found that, in a high strength hot rolled steel plate having a strength of not less than 770 $N/mm^2$, increasing the diameter of ferrite grains is effective for improving the ductility. This has led to the completion of the third aspect of the present invention. That is, the third aspect of the present invention has been attained by drawing attention, in a ferrite-bainite steel, to ferrite for enhancing the ductility and to precipitates of TiC and/or NbC for ensuring the strength and finding a relational expression for satisfactorily growing ferrite grains to improve the ductility without sacrificing the bore expandability and then producing precipitates to ensure the strength.

Thus, according to the third aspect of the present invention, there is provided a high strength hot rolled steel plate having excellent bore expandability and ductility, comprising a steel comprising, by mass, 0.01 to 0.15% of carbon; 0.30 to 2.00% of silicon; 0.50 to 3.00% of manganese; phosphorus ≦0.03%; sulfur ≦0.005%; 0.01 to 0.50% of titanium and/or 0.01 to 0.05% of niobium; and the balance consisting of iron and unavoidable impurities, the contents of carbon (C), silicon (Si), manganese (Mn), titanium (Ti), and niobium (Nb) satisfying a requirement represented by formula:

$$115 \leqq (917-480[C\ \%]+100[Si\ \%]-100[Mn\ \%])-(790\times([Ti\ \%]+[Nb\ \%]/2)^{0.05}) \leqq 235,$$

said steel plate having a steel structure comprising not less than 80% of ferrite and the balance consisting of bainite, said steel plate having a strength of not less than 770 $N/mm^2$.

These high strength hot rolled steel plates having excellent bore expandability and ductility can be produced by a production process comprising the steps of: subjecting the steel having said chemical composition to hot rolling in such a manner that the rolling termination temperature is $Ar_3$ transformation temperature to 950° C.; subsequently cooling the hot rolled steel plate to 650 to 800° C. at a cooling rate of not less than 20° C./sec.; then air-cooling the steel plate for 2 to 15 sec.; further cooling the steel plate to 350 to 600° C. at a cooling rate of not less than 20° C./sec.; and coiling the steel plate.

DETAILED DESCRIPTION OF THE INVENTION

Figure 1:
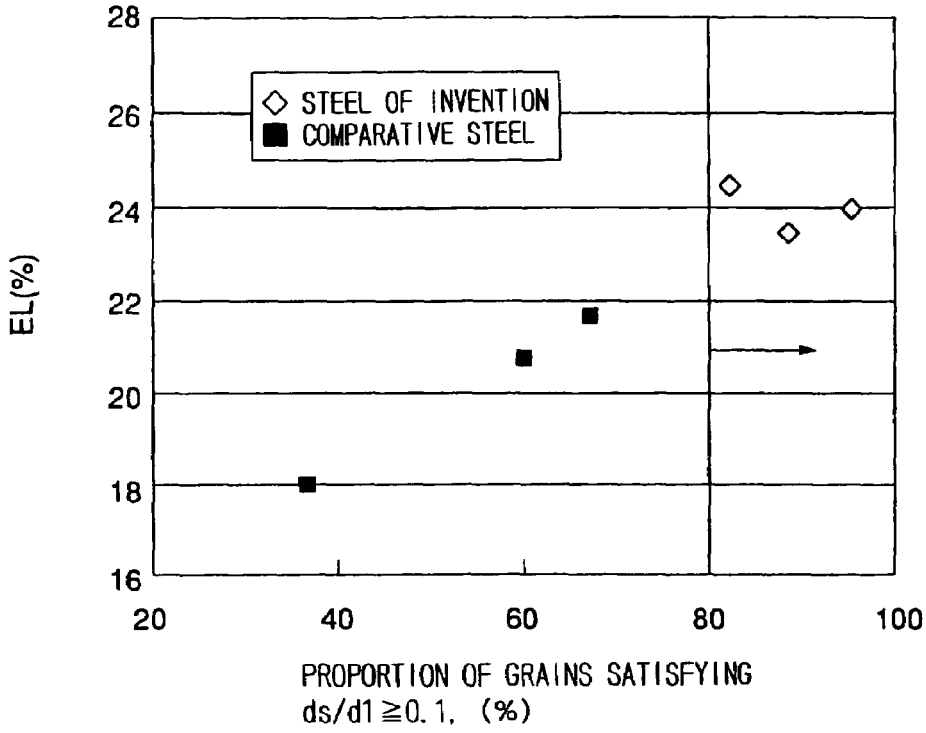
FIG. 1 is a scatter diagram showing a correlation between the proportion of grains of ds/dl≧0.1 and the elongation for steels according to the first aspect of the present invention and comparative steels.

Basic Chemical Composition of High Strength Hot Rolled Steel Plate

In the present invention, the content of carbon (C) in the high strength hot rolled steel plate is 0.01 to 0.15%, preferably 0.01 to 0.08%. Carbon is an element necessary for precipitating carbides to ensure strength. When the carbon content is less than 0.01%, it is difficult to ensure desired strength. On the other hand, when the carbon content exceeds 0.15%, the ductility is significantly lowered. In particular, the addition of carbon is effective for realizing a strength of not less than 980 $N/mm^2$. From the viewpoint of providing a combination of the strength of not less than 980 $N/mm^2$ with a high level of bore expandability and a high level of ductility, however, the carbon content is preferably brought to not more than 0.08%.

Silicon (Si) is one of the most important elements in the present invention and is important for suppressing the formation of harmful carbides to bring the structure to a composite structure composed mainly of ferrite with the balance consisting of bainite, and, further, the addition of silicon can provide a combination of strength with ductility. The addition of silicon in an amount of not less than 0.3% is necessary for attaining this effect. Increasing the amount of silicon added, however, deteriorates chemical conversion treatment and, in addition, deteriorates spot weldability. For this reason, the upper limit of the amount of silicon added is 2.0%. In particular, the addition of silicon is effective for realizing a strength of not less than 980 $N/mm^2$. In order to realize a combination of the strength of not less than 980 $N/mm^2$ with a high level of bore expandability and a high level of ductility, however, the silicon content is preferably not more than 1.5%. A silicon content in the range of 0.9 to 1.2% is particularly preferred from the viewpoint of effectively realizing the combination of the strength of not less than 980 $N/mm^2$ with the high level of bore expandability and the high level of ductility.

Manganese (Mn) is one of elements important to the present invention and is necessary for ensuring the strength. To this end, the addition of manganese in an amount of not less than 0.50% is necessary. The addition of manganese in a large amount exceeding 3.0%, however, is likely to cause microsegregation and macrosegregation, which deteriorate the bore expandability. In particular, in order to realize a strength of not less than 980 $N/mm^2$, the addition of manganese is effective. The manganese content, however, is preferably not more than 2.5% from the viewpoint of realizing a combination of the strength of not less than 980 $N/mm^2$ with a high level of bore expandability and a high level of ductility. The manganese content is particularly preferably in the range of 1.00 to 1.50% from the viewpoint of effectively realizing the combination of the strength of not less than 980 $N/mm^2$ with the high level of bore expandability and the high level of ductility.

Phosphorus (P) is dissolved in ferrite to form a solid solution which deteriorates the ductility of the hot rolled steel plate. For this reason, the content of phosphorus is limited to not more than 0.03%. Sulfur (S) forms MnS which functions as the origin of a failure and significantly deteriorates the bore expandability and the ductility. Therefore, the content of sulfur is limited to not more than 0.005%.

Titanium (Ti) and niobium (Nb) each are also one of the most important elements in the present invention and are useful for precipitating fine carbides, such as TiC and NbC, to ensure the strength. To this end, the addition of 0.05 to 0.50% of titanium and/or 0.01 to 0.05% of niobium is necessary.

When the titanium content is less than 0.05% and the niobium content is less than 0.01%, it is difficult to ensure the strength. On the other hand, when the titanium content exceeds 0.50% and/or the niobium content exceeds 0.05%, the amount of the precipitate is so large that the ductility is deteriorated. In particular, in order to realize a strength of not less than 980 $N/mm^2$, the addition of titanium and niobium is effective. From the viewpoint of realizing a combination of the strength of not less than 980 $N/mm^2$ with a high level of bore expandability and a high level of ductility, however, the titanium content is preferably not more than 0.20% with the niobium content being not more than 0.04%.

Calcium and rare earth elements (REMS) are elements that are useful for regulating the form of sulfide inclusions to improve the bore expandability. In order to attain significant form regulation effect, the addition of not less than 0.0005% of at least one member selected from calcium and REMs is preferred. On the other hand, the addition of an excessively large amount of calcium and REMs leads to coarsening of sulfide inclusions, deteriorates the cleanness, and lowers the ductility. This further leads to an increase in cost. For the above reason, the upper limit of the content of calcium and REMs is 0.01%.

High Strength Hot Rolled Steel Plate According to First Embodiment

The ratio (ds/dl) of the minor axis (ds) to the major axis (dl) in the grains is an index of the level of grain growth and is one of the most important indexes in the first embodiment of the present invention. In order to simultaneously realize a high level of bore expandability and a high level of ductility, grains should be grown to a minor axis/major axis ratio (ds/dl) of not less than 0.1. When the minor axis/major axis ratio in the grains is less than 0.1, grains are flat and are not satisfactorily recovered grains. This is causative of a deterioration in ductility. Not less than 80% of all the grains should be accounted for by grains having this minor axis/major axis ratio. When the above proportion is less than 80%, the ductility is deteriorated. In this case, when the tensile strength is not less than 690 $N/mm^2$, a high level of ductility and a high level of bore expandability cannot be simultaneously realized. FIG. 1 is a diagram showing the correlation between the proportion of grains having minor axis/major axis ratio $\geqq 0.1$ and the elongation in high strength hot rolled steel plates having a tensile strength of 780 to 820 $N/mm^2$ and a $\lambda$ value (bore expansion or enlargement value) of 100 to 115. As can be seen from FIG. 1, when the proportion is less than 80%, the ductility is unfavorably deteriorated. Accordingly, in the first embodiment of the present invention, in order to simultaneously realize a high level of bore expandability and a high level of ductility, the proportion of grains having minor axis/major axis ratio $\geqq 0.1$ in all the grains should be not less than 80%. Preferably, the proportion of grains having minor axis/major axis ratio $\geqq 0.2$ is not less than 80% from the viewpoint of attaining more significant effect.

The high strength hot rolled steel plate possessing excellent bore expandability and ductility according to the present invention may be produced by hot rolling a semi-finished steel product containing the above constituents, such as a slab. In this case, the steel structure in the high strength hot rolled steel plate should be a duplex structure comprising not less than 80% of ferrite with the balance consisting of bainite. When the amount of ferrite is less than 80%, the ductility is significantly deteriorated and, thus, the amount of ferrite in the ferrite-bainite structure should be not less than 80%.

High Strength Hot Rolled Steel Plate According to Second Embodiment

Figure 2:
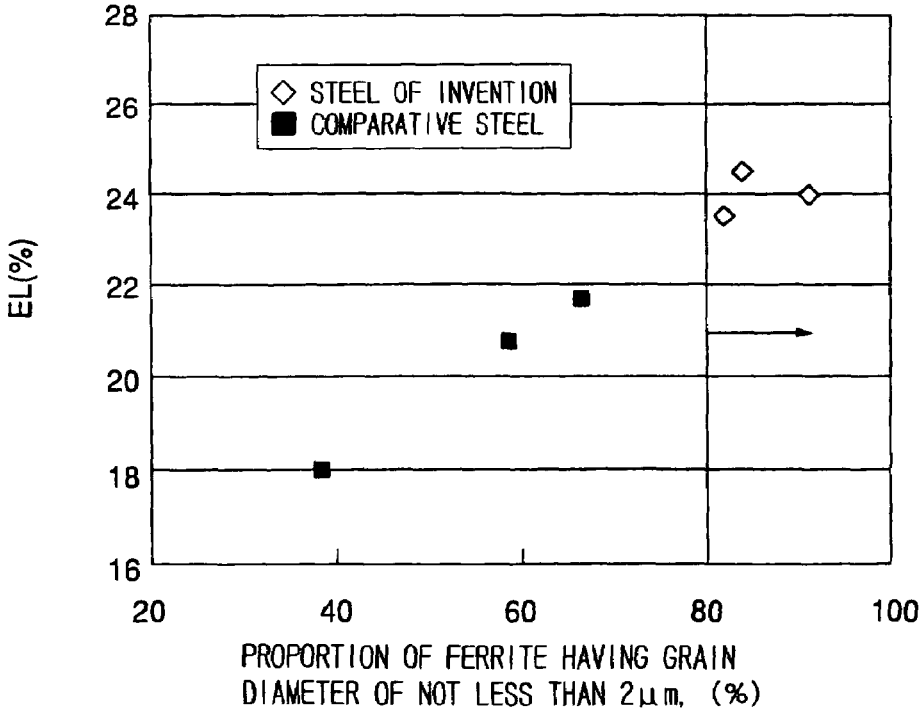
FIG. 2 is a scatter diagram showing a correlation between the proportion of ferrite having a grain diameter of not less than 2 μm and the elongation in high strength hot rolled steel plates for steels according to the second aspect of the present invention and comparative steels.

The diameter of ferrite grains is one of the most important indexes in this embodiment. As a result of extensive and intensive studies conducted by the present inventors, it have been found that, when the percentage area of ferrite having a grain diameter of not less than 2 μm is not less than 80%, both the bore expandability and the ductility are excellent. Specifically, as shown in FIG. 2 (an example of a high strength hot rolled steel plate having a tensile strength of 780 to 820 $N/mm^2$ and a $\lambda$ value of 100 to 115), when the proportion of ferrite grains having a diameter of not less than 2 μm is not less than 80%, the steel plates have a high level of ductility. When the grain diameter is less than 2 μm, grains are not satisfactorily recovered, grown grains. This is causative of a deterioration in ductility. Accordingly, in the second embodiment of the present invention, the proportion of ferrite grains having a diameter of not less than 2 μm should be not less than 80% from the viewpoint of simultaneously realizing good bore expandability and good ductility. Preferably, the proportion of ferrite grains having a diameter of not less than 3 μm is not less than 80% for attaining more significant effect. The grain diameter may be determined by converting the area of each grain into equivalent circle diameter.

The steel structure in the high strength hot rolled steel plate is comprised of ferrite and bainite. Here since not less than 80% of ferrite having a grain diameter of not less than 2 μm is contained in the steel structure, the steel structure is a ferrite-bainite duplex steel structure having a ferrite content of not less than 80%. For example, the steel structure according to the present invention may be a ferrite-bainite structure comprising not less than 80% of ferrite having a grain diameter of not less than 2 μm with the balance consisting of ferrite having a grain diameter of less than 2 μm and bainite, or a ferrite-bainite structure comprising not less than 80% of ferrite having a grain diameter of not less than 2 μm with the balance consisting of bainite only. The reason why the content of the bainite should be not more than 20% is that the presence of bainite in an amount of more than 20% increases the level of a deterioration in ductility.

High Strength Hot Rolled Steel Plate According to Third Embodiment

In the third embodiment of the present invention, the contents of carbon (C), silicon (Si), manganese (Mn), titanium (Ti), and niobium (Nb) should satisfy a requirement represented by formula:

$$115 \leqq (917-480[C\,\%]+100[Si\,\%]-100[Mn\,\%])-(790\times([Ti\,\%]+[Nb\,\%]/2)^{0.05}) \leqq 235$$

The left term of the formula, i.e., (917−480[C %]+100[Si %]−100[Mn %]), exhibits easiness in the formation of ferrite, while the right term of the formula, i.e., $(790\times([Ti\,\%]+[Nb\,\%]/2)^{0.05})$, exhibits easiness in the precipitation of carbides, such as TiC and NbC. In order to preferentially produce ferrite to grow ferrite grains, the precipitation of carbides having the effect of inhibiting the grown of grains should be suppressed. To this end, the value obtained by the calculation formula should be not less than 115. On the other hand, when the precipitation of carbides is excessively suppressed, carbon in solid solution is enriched in bainite to increase the hardness of bainite. This increases the difference in hardness between ferrite and bainite and consequently deteriorates the bore expandability. For this reason, the value obtained by the calculation formula should be brought to not more than 235 for effectively precipitating carbides to improve the bore expandability.

The high strength hot rolled steel plate possessing excellent bore expandability and ductility according to the present invention may be produced by hot rolling a semi-finished steel product containing the above constituents, such as a slab. In this case, the steel structure in the high strength hot rolled steel plate should be a duplex structure comprising not less than 80% of ferrite and the balance consisting of bainite. When the amount of ferrite is less than 80%, the ductility is significantly deteriorated and, thus, the amount of ferrite in the ferrite-bainite structure should be not less than 80%. In this connection, it should be noted that a minor amount of residual γ is sometimes contained in bainite.

High Strength Hot Rolled Steel Plate According to Fourth Embodiment

According to the fourth embodiment, which is a preferred embodiment of the present invention, preferably, not less than 80% of all the grains are accounted for by grains having a minor axis (ds) to major axis (dl) ratio (ds/dl) of not less than 0.1, the strength is not less than 690 $N/mm^2$, and, further, the steel structure is a ferrite-bainite duplex structure in which the proportion of ferrite having a grain diameter of not less than 2 μm is not less than 80%.

The steel plate according to the fourth embodiment has both the features of the first embodiment and the features of the second embodiment. Specifically, each of the first and second embodiments also can improve the ductility. A combination of these embodiments, however, can further improve the bore expandability. While there is no intention of being bound by any particular theory, two measures, i.e., the homogenization of the structure and a reduction in the number of origins of cracks, are effective for improving the bore expandability, and the interface of the ferrite phase and the bainite phase can be reduced by regulating both the aspect ratio (ds/dl) and the proportion of ferrite having a grain diameter of not less than 2 μm so as to fall within the above respective predetermined ranges. It is considered that the above fact can reduce the number of origins of cracks at the time of bore expanding to improve the bore expandability. This function can also be realized by the first or second embodiment. The fourth embodiment, which is a combination of the first and second embodiments, can provide the most effective function.

High Strength Hot Rolled Steel Plate According to Fifth Embodiment

According to the fifth embodiment, which is a preferred embodiment of the present invention, in the steel plate having the above basic chemical composition, preferably, not less than 80% of all the grains is accounted for by grains having a minor axis (ds) to major axis (dl) ratio (ds/dl) of not less than 0.1, the steel structure comprises not less than 80% of ferrite and the balance consisting of bainite, the strength is not less than 770 $N/mm^2$, and, in addition, the contents of carbon (C), silicon (Si), manganese (Mn), titanium (Ti), and niobium (Nb) satisfy a requirement represented by formula:

$$115 \leqq (917-480[C\ \%]+100[Si\ \%]-100[Mn\ \%])-(790\times([Ti\ \%]+[Nb\ \%]/2)^{0.05}) \leqq 235$$

The steel plate according to this fifth embodiment has both the features of the first embodiment and the features of the third embodiment. Specifically, the first embodiment is effective in improving the ductility, while the third embodiment is effective in improving the bore expandability. A combination of the first embodiment with the third embodiment, however, can provide a synergistic effect on an improvement in ductility and an improvement in bore expandability. Further, when the chemical composition falls within the range represented by the above formula, the control of the formation of alloy carbides advantageously facilitates satisfying the above requirement for the form of ferrite. While there is no intention of being bound by any particular theory, two measures, i.e., the homogenization of the structure and a reduction in the number of origins of cracks, are effective for improving the bore expandability. It is considered that an improvement in the former, i.e., homogenization of the structure, by the above formula and an improvement in the latter, i.e., a reduction in the number of origins of cracks, by controlling the form of ferrite can provide a synergistic effect on an improvement in bore expandability.

High Strength Hot Rolled Steel Plate According to Sixth Embodiment

According to the sixth embodiment, which is a preferred embodiment of the present invention, in the steel plate having the above basic chemical composition, preferably, the steel structure is a ferrite-bainite duplex structure, in which the proportion of ferrite having a grain diameter of not less than 2 μm is not less than 80%, the strength is not less than 770 $N/mm^2$, and the contents of carbon (C), silicon (Si), manganese (Mn), titanium (Ti), and niobium (Nb) satisfy a requirement represented by formula:

$$115 \leqq (917-480[C\ \%]+100[Si\ \%]-100[Mn\ \%])-(790\times([Ti\ \%]+[Nb\ \%]/2)^{0.05}) \leqq 235.$$

The steel plate according to this sixth embodiment has both the features of the second embodiment and the features of the third embodiment. Specifically, the second embodiment is effective in improving the ductility, while the third embodiment is effective in improving the bore expandability. A combination of the second embodiment with the third embodiment, however, can provide a synergistic effect on an improvement in ductility and an improvement in bore expandability. Further, when the chemical composition falls within the range represented by the above formula, the control of the formation of alloy carbides advantageously facilitates satisfying the above requirement for the grain diameter of ferrite. While there is no intention of being bound by any particular theory, two measures, i.e., the homogenization of the structure and a reduction in the number of origins of cracks, are effective for improving the bore expandability. It is considered that an improvement in the former, i.e., homogenization of the structure, by the above formula and an improvement in the latter, i.e., a reduction in the number of origins of cracks, by the control of grain diameter of ferrite can provide a synergistic effect on an improvement in bore expandability.

High Strength Hot Rolled Steel Plate According to Seventh Embodiment

According to the seventh embodiment, which is a preferred embodiment of the present invention, in the steel plate having the above basic chemical composition, preferably, not less than 80% of all the grains is accounted for by grains having a minor axis (ds) to major axis (dl) ratio (ds/dl) of not less than 0.1, the strength is not less than 770 N/mm$^2$, and the steel structure is a ferrite-bainite duplex structure in which the proportion of ferrite having a grain diameter of not less than 2 μm is not less than 80%, and, further, the contents of carbon (C), silicon (Si), manganese (Mn), titanium (Ti), and niobium (Nb) satisfy a requirement represented by formula:

$$115 \leqq (917-480[C\ \%]+100[Si\ \%]-100[Mn\ \%])-(790\times([Ti\ \%]+[Nb\ \%]/2)^{0.05}) \leqq 235.$$

The steel plate according to this seventh embodiment has all the features of the first, second, and third embodiments. Specifically, each of the first and second embodiments is effective in improving the ductility, and the third embodiment is effective in improving the bore expandability. A combination of all of these embodiments, however, can realize a synergistic effect on the improvement in ductility and the improvement in bore expandability. When the chemical composition falls within the range represented by the above formula, the control of the formation of alloy carbides advantageously facilitates satisfying the above requirements for the grain diameter of ferrite and the form of ferrite. While there is no intention of being bound by any particular theory, two measures, i.e., the homogenization of the structure and a reduction in the number of origins of cracks, are effective for improving the bore expandability. It is considered that an improvement in the former, i.e., homogenization of the structure, by the above formula and an improvement in the latter, i.e., a reduction in the number of origins of cracks, by controlling the grain diameter of ferrite and the form of ferrite can provide a synergistic effect on an improvement in bore expandability.

Production Process

The high strength hot rolled steel plates possessing excellent bore expandability and ductility according to the above embodiments of the present invention can be produced as follows. At the outset, a semi-finished steel product having the above basic chemical composition is provided according to each embodiment. This semi-finished steel product is hot rolled in such a manner that the rolling termination temperature is $Ar_3$ transformation temperature to 950° C., from the viewpoint of suppressing the formation of ferrite to realize good bore expandability. Subsequently, the hot rolled steel plate is cooled to 650 to 800° C. at a cooling rate of not less than 20° C./sec. and is then air cooled for 2 to 15 sec. Further, the air-cooled steel plate is cooled to 350 to 600° C. at a cooling rate of not less than 20° C./sec. and is then coiled. The rolling termination temperature should be $Ar_3$ transformation temperature or above from the viewpoint of suppressing the formation of ferrite and realizing good bore expandability. Since, however, an excessively high rolling termination temperature leads to a deterioration in strength and ductility due to coarsening of the structure, the finish rolling termination temperature should be 950° C. or below.

Rapidly cooling the steel plate immediately after the completion of rolling is important for realizing a high level of bore expandability. The cooling rate should be not less than 20° C./sec., because, when the cooling rate is less than 20° C./sec., it becomes difficult to suppress the formation of carbides which are harmful to the bore expandability.

Next, once stopping rapid cooling of the steel plate followed by air cooling is important for precipitating ferrite to increase the proportion of ferrite and to improve the ductility. When the air cooling start temperature is below 650° C., pearlite, which is harmful to bore expandability, however, is formed from an early stage. On the other hand, when the air cooling start temperature is above 800° C., the formation of ferrite is delayed making it difficult to attain the effect of air cooling. Further, in this case, the pearlite is likely to be formed in subsequent cooling. For this reason, the air cooling start temperature is between 650° C. and 800° C. When the air cooling time exceeds 15 sec., an increase in the amount of ferrite is saturated and, in addition, a load is imposed on the control of subsequent cooling rate and coiling temperature. For the above reason, the air cooling time is not more than 15 sec. When the air cooling time is less than 2 sec., ferrite cannot be satisfactorily precipitated.

After air cooling, the steel plate is rapidly cooled again. Also in this case, the cooling rate should be not less than 20° C./sec., because, when the cooling rate is less than 20° C./sec., harmful pearlite is likely to be formed. The stop temperature of this rapid cooling, that is, the coiling temperature, is 350 to 600° C. When the coiling temperature is below 350° C., hard martensite harmful to the bore exapandability is formed. On the other hand, when the coiling temperature is above 600° C., pearlite and grain boundary cementite harmful to the bore expandability are likely to be formed.

All the steel plates according to the first to seventh embodiments can be produced by combining the above chemical compositions with the above hot rolling conditions. Further, it should be noted that, even when the steel plates according to the present invention have been surface treated (for example, galvanized), the effect of the present invention is not lost and this embodiment does not depart from the present invention.

EXAMPLES

Example A

Steels having chemical compositions shown in Table A1 were produced by a melt process in a converter, followed by continuous casting to produce slabs. The slabs were rolled under hot rolling conditions shown in Table Al and were then cooled to produce hot rolled steel plates having a thickness of 2.6 to 3.2 mm.

TABLE A1

| | Chemical composition, mass % | | | | | | | | | Finishing | Air cooling | Coiling |
|---|---|---|---|---|---|---|---|---|---|---|---|---|
| No. | C | Si | Mn | P | S | Ti | Nb | Ca | REM | temp., ° C. | start temp., ° C. | temp., ° C. |
| A1 | 0.03 | 1.50 | 1.00 | 0.006 | 0.001 | 0.155 | — | — | — | 930 | 710 | 500 |
| A2 | 0.03 | 1.05 | 1.35 | 0.007 | 0.001 | 0.125 | 0.025 | 0.0025 | — | 910 | 720 | 450 |
| A3 | 0.04 | 0.86 | 1.50 | 0.006 | 0.001 | 0.150 | — | 0.0030 | — | 920 | 720 | 480 |
| A4 | 0.04 | 1.45 | 1.90 | 0.007 | 0.001 | 0.110 | — | — | — | 920 | 680 | 480 |
| A5 | 0.04 | 1.45 | 1.95 | 0.007 | 0.001 | 0.165 | 0.035 | — | — | 900 | 700 | 510 |
| A6 | 0.05 | 1.40 | 0.95 | 0.006 | 0.001 | 0.135 | 0.030 | 0.0030 | — | 890 | 700 | 370 |
| A7 | 0.05 | 1.25 | 1.60 | 0.008 | 0.001 | 0.140 | 0.030 | — | — | 890 | 650 | 500 |
| A8 | 0.06 | 1.25 | 1.60 | 0.006 | 0.001 | 0.150 | — | 0.0025 | — | 910 | 720 | 570 |

TABLE A1-continued

| No. | Chemical composition, mass % C | Si | Mn | P | S | Ti | Nb | Ca | REM | Finishing temp., ° C. | Air cooling start temp., ° C. | Coiling temp., ° C. |
|---|---|---|---|---|---|---|---|---|---|---|---|---|
| A9 | 0.06 | 1.00 | 1.55 | 0.007 | 0.001 | 0.130 | 0.025 | 0.0025 | — | 900 | 750 | 480 |
| A10 | 0.05 | 0.85 | 0.60 | 0.006 | 0.001 | 0.050 | — | — | — | 900 | 710 | 520 |
| A11 | 0.04 | 0.95 | 1.35 | 0.008 | 0.001 | 0.120 | 0.030 | — | 0.0025 | 910 | 710 | 500 |

TABLE A2

| No. | Tensile strength, N/mm$^2$ | Elongation, % | λ value, % | Structure | Proportion of ferrite, % | Proportion of ferrite having grain diameter of not less than 2 μm, % | Proportion of ds/dl ≧ 0.1, % | Value obtained by calculation formula | Aspect No. of invention |
|---|---|---|---|---|---|---|---|---|---|
| A1 | 791 | 24.5 | 103 | F + B | 87 | 85 | 86 | 232.9 | 1 |
| A2 | 796 | 24.0 | 119 | F + B | 87 | 84 | 91 | 157.2 | 1 |
| A3 | 787 | 23.5 | 110 | F + B | 85 | *73 | 88 | 115.3 | 1 |
| A4 | 793 | 24.0 | 117 | F + B | 84 | *75 | 87 | 145.3 | 1 |
| A5 | 984 | 14.0 | 108 | F + B | 80 | *69 | 80 | 122.2 | 1 |
| A6 | 825 | 22.0 | 105 | F + B | 86 | *76 | 82 | 219.5 | 1 |
| A7 | 883 | 17.0 | 117 | F + B | 80 | *70 | 83 | 138.3 | 1 |
| A8 | 834 | 18.0 | 120 | F + B | 81 | *71 | 85 | 134.7 | 1 |
| A9 | 835 | 19.0 | 112 | F + B | 83 | *77 | 86 | 116.5 | 1 |
| A10 | 699 | 27.0 | 135 | F + B | 87 | *78 | 81 | *237.9 | 1 |
| A11 | 797 | 23.5 | 117 | F + B | 84 | *75 | 86 | 143.1 | 1 |

Note
F: ferrite,
B: bainite

JIS No. 5 test pieces were extracted from the hot rolled steel plates thus obtained and were subjected to a tensile test, a bore expansion test, and observation of structure. All the grains were traced using optical photomicrographs with 30 visual fields, and, for each traced grain, the ratio (ds/dl) of the minor axis to the major axis was determined. For the bore expansion test, the bore, formed by punching, having an initial bore diameter ($d_0$: 10 mm), was expanded by a 60-degree conical punch to determine the bore diameter (d) at which cracking on a level, which had passed through the plate thickness, occurred. This bore diameter (d) was used to determine and evaluate the bore expansion value (λ value)=$(d-d_0)/d_0\times100$. The results are shown in Table A2.

All of Nos. A1 to A11 are examples of the present invention wherein all the chemical composition, the finishing temperature, the air cooling start temperature, and the coiling temperature fall within the scope of the present invention and, at the same time, not less than 80% of all the grains is accounted for by grains having a minor axis/major axis (ds/dl) ratio of not less than 0.1. All of these plates were high strength hot rolled steel plates having a high λ value and a high level of elongation, that is, possessing excellent bore expandability and ductility.

In the case of hot rolling using a steel having a chemical composition of No. A1 under conditions of finishing temperature 920° C., air cooling start temperature 625° C., and coiling temperature 460° C., due to the air cooling start temperature below the air cooling start temperature range specified in the present invention, pearlite was formed in the structure, and the proportion of ferrite was as low as 76%. Consequently, the elongation was 20%, and the λ value was 93%, indicating that the balance between the bore expandability and the ductility was poor. Likewise, in the case of hot rolling using a steel having a chemical composition of No. A1 under conditions of finishing temperature 910° C., air cooling start temperature 690° C., and coiling temperature 330° C., due to the coiling temperature below the coiling temperature range specified in the present invention, martensite was formed in the structure, and, at the coiling temperature, the proportion of ferrite was as low as 64%. Consequently, the elongation was 20%, and the X value was 64%, indicating that, here again, the balance between the bore expandability and the ductility was poor.

Example B

Steels having chemical compositions shown in Table B1 were produced by a melt process in a converter, followed by continuous casting to produce slabs. The slabs were rolled under hot rolling conditions shown in Table B1 and were then cooled to produce hot rolled steel plates having a thickness of 2.6 to 3.2 mm. In this example, the rate of rapid cooling was 40° C./sec., and the air cooling time was 10 sec.

TABLE B1

| No. | Chemical composition, mass % C | Si | Mn | P | S | Ti | Nb | Ca | REM | Finishing temp., ° C. | Air cooling start temp., ° C. | Coiling temp., ° C. |
|---|---|---|---|---|---|---|---|---|---|---|---|---|
| B1 | 0.03 | 1.05 | 1.80 | 0.006 | 0.001 | 0.120 | — | — | — | 910 | 710 | 500 |
| B2 | 0.03 | 0.95 | 1.55 | 0.006 | 0.001 | 0.150 | — | 0.0025 | — | 900 | 700 | 500 |
| B3 | 0.03 | 1.25 | 1.15 | 0.006 | 0.001 | 0.140 | 0.030 | 0.0025 | — | 900 | 720 | 450 |
| B4 | 0.04 | 1.45 | 1.00 | 0.006 | 0.001 | 0.150 | — | — | — | 920 | 720 | 480 |

TABLE B1-continued

| No. | Chemical composition, mass % | | | | | | | | | Finishing temp., ° C. | Air cooling start temp., ° C. | Coiling temp., ° C. |
|---|---|---|---|---|---|---|---|---|---|---|---|---|
| | C | Si | Mn | P | S | Ti | Nb | Ca | REM | | | |
| B5 | 0.04 | 1.35 | 1.65 | 0.006 | 0.001 | 0.120 | 0.030 | — | — | 900 | 670 | 520 |
| B6 | 0.04 | 0.65 | 1.50 | 0.006 | 0.001 | 0.100 | — | 0.0025 | — | 920 | 700 | 500 |
| B7 | 0.05 | 1.35 | 1.75 | 0.006 | 0.001 | 0.180 | 0.030 | 0.0025 | — | 880 | 700 | 400 |
| B8 | 0.05 | 0.85 | 1.40 | 0.006 | 0.001 | 0.150 | — | — | — | 890 | 650 | 480 |
| B9 | 0.06 | 1.20 | 1.05 | 0.006 | 0.001 | 0.135 | 0.030 | — | — | 900 | 740 | 480 |
| B10 | 0.06 | 1.35 | 1.25 | 0.006 | 0.001 | 0.135 | — | 0.0025 | — | 930 | 700 | 570 |
| B11 | 0.04 | 0.95 | 1.35 | 0.006 | 0.001 | 0.125 | 0.025 | — | 0.0025 | 910 | 690 | 510 |

TABLE B2

| No. | Tensile strength, N/mm$^2$ | Elongation, % | λ value, % | Structure | Proportion of ferrite, % | Proportion of ferrite having grain diameter of not less than 2 μm, % | Proportion of ds/dl ≧ 0.1, % | Value obtained by calculation formula | Aspect No. of invention |
|---|---|---|---|---|---|---|---|---|---|
| B1 | 800 | 23.5 | 113 | F + B | 83 | 82 | *79 | 117.1 | 2 |
| B2 | 793 | 24.0 | 118 | F + B | 87 | 85 | 87 | 124.1 | 2 |
| B3 | 832 | 18.0 | 118 | F + B | 90 | 88 | *78 | 192.9 | 2 |
| B4 | 783 | 24.5 | 103 | F + B | 85 | 84 | *75 | 224.3 | 2 |
| B5 | 853 | 17.0 | 115 | F + B | 86 | 83 | *76 | 153.1 | 2 |
| B6 | 717 | 22.0 | 122 | F + B | 90 | 89 | 82 | *108.7 | 2 |
| B7 | 976 | 15.0 | 108 | F + B | 91 | 89 | *79 | 125.0 | 2 |
| B8 | 782 | 24.0 | 115 | F + B | 93 | 92 | *79 | 119.5 | 2 |
| B9 | 825 | 18.0 | 118 | F + B | 88 | 86 | *77 | 184.7 | 2 |
| B10 | 782 | 24.0 | 120 | F + B | 84 | 83 | 83 | 183.5 | 2 |
| B11 | 794 | 23.5 | 119 | F + B | 85 | 82 | *75 | 142.4 | 2 |

Note
F: ferrite,
B: bainite

JIS No. 5 test pieces were extracted from the hot rolled steel plates thus obtained and were subjected to a tensile test, a bore expansion test, and observation of structure. For the observation of the structure, the test pieces were corroded by nital, ferrite and bainite were then identified under a scanning electron microscope, and the percentage area of ferrite having a grain diameter of not less than 2 μm was measured by image analysis. For the bore expansion test, the bore, formed by punching, having an initial bore diameter ($d_o$: 10 mm), was expanded by a 60-degree conical punch to determine the bore diameter (d) at which cracking on a level, which had passed through the plate thickness, occurred. This bore diameter (d) was used to determine and evaluate the bore expansion value (λ value)=$(d-d_0)/d_0\times100$. The results are shown in Table B2.

All of Nos. B1 to B11 are examples of the present invention wherein all the chemical composition, the finishing temperature, the air cooling start temperature, and the coiling temperature fall within the scope of the present invention, the structure comprises ferrite and bainite, and, at the same time, the proportion of ferrite having a grain diameter of not less than 2 μm is not less than 80%. All of these plates were high strength hot rolled steel plates having a high λ value and a high level of elongation, that is, possessing excellent bore expandability and ductility.

In the case of hot rolling (not shown in the table) using a steel having a chemical composition of No. B1 under conditions of finishing temperature 920° C., air cooling start temperature 625° C., and coiling temperature 460° C., due to the air cooling start temperature below the air cooling start temperature range specified in the present invention, pearlite was formed in the structure, and the percentage area of ferrite having a grain diameter of not less than 2 μm was as low as 75%.

Consequently, the elongation was 19%, and the λ value was 95%, indicating that the balance between the bore expandability and the ductility was poor. Likewise, in the case of hot rolling using a steel having a chemical composition of No. B1 under conditions of finishing temperature 910° C., air cooling start temperature 680° C., and coiling temperature 320° C., due to the coiling temperature below the coiling temperature range specified in the present invention, martensite was formed in the structure, and the percentage area of ferrite having a grain diameter of not less than 2 μm was as low as 63%. Consequently, the elongation was 20%, and the λ value was 63%, indicating that, here again, the balance between the bore expandability and the ductility was poor.

Example C

Steels having chemical compositions shown in Table C1 were produced by a melt process in a converter, followed by continuous casting to produce slabs. The slabs were rolled under hot rolling conditions shown in Table C1 and were then cooled to produce hot rolled steel plates having a thickness of 2.6 to 3.2 mm. In this example, the rate of rapid cooling was 40° C./sec., and the air cooling time was 10 sec.

TABLE C1

| No. | Chemical composition, mass % | | | | | | | | | Finishing temp., ° C. | Air cooling start temp., ° C. | Coiling temp., ° C. |
|---|---|---|---|---|---|---|---|---|---|---|---|---|
| | C | Si | Mn | P | S | Ti | Nb | Ca | REM | | | |
| C1 | 0.03 | 1.55 | 2.00 | 0.006 | 0.001 | 0.100 | — | — | — | 920 | 720 | 450 |
| C2 | 0.03 | 0.90 | 1.50 | 0.007 | 0.001 | 0.150 | — | 0.0025 | — | 920 | 720 | 500 |
| C3 | 0.03 | 1.20 | 1.25 | 0.006 | 0.001 | 0.130 | 0.030 | — | — | 930 | 700 | 500 |
| C4 | 0.04 | 1.50 | 1.00 | 0.006 | 0.001 | 0.150 | — | — | — | 910 | 680 | 480 |
| C5 | 0.04 | 1.15 | 1.30 | 0.007 | 0.001 | 0.120 | 0.030 | 0.0030 | — | 920 | 700 | 500 |
| C6 | 0.05 | 1.05 | 1.40 | 0.008 | 0.001 | 0.130 | 0.030 | — | — | 890 | 720 | 530 |
| C7 | 0.05 | 1.20 | 1.45 | 0.007 | 0.001 | 0.135 | — | — | — | 890 | 700 | 580 |
| C8 | 0.05 | 1.35 | 1.85 | 0.006 | 0.001 | 0.175 | 0.035 | 0.0030 | — | 900 | 650 | 490 |
| C9 | 0.06 | 1.20 | 1.45 | 0.007 | 0.001 | 0.135 | — | 0.0025 | — | 900 | 720 | 370 |
| C10 | 0.06 | 1.25 | 1.05 | 0.006 | 0.001 | 0.130 | 0.025 | — | — | 900 | 750 | 510 |
| C11 | 0.04 | 1.15 | 1.30 | 0.007 | 0.001 | 0.150 | 0.030 | — | 0.0025 | 920 | 700 | 500 |

TABLE C2

| No. | Tensile strength, N/mm$^2$ | Elongation, % | λ value, % | Structure | Proportion of ferrite, % | Proportion of ferrite having grain diameter of not less than 2 μm, % | Proportion of ds/dl ≧ 0.1, % | Value obtained by calculation formula | Aspect No. of invention |
|---|---|---|---|---|---|---|---|---|---|
| C1 | 786 | 24.0 | 115 | F + B | 82 | *73 | 80 | 153.5 | 3 |
| C2 | 785 | 24.0 | 113 | F + B | 83 | *75 | 81 | 124.1 | 3 |
| C3 | 819 | 22.5 | 121 | F + B | 85 | *72 | *78 | 180.3 | 3 |
| C4 | 787 | 24.0 | 103 | F + B | 88 | *76 | *78 | 229.3 | 3 |
| C5 | 807 | 23.0 | 117 | F + B | 86 | 82 | *79 | 168.1 | 3 |
| C6 | 831 | 18.0 | 120 | F + B | 81 | *74 | *79 | 140.7 | 3 |
| C7 | 784 | 24.0 | 118 | F + B | 83 | 81 | 80 | 153.3 | 3 |
| C8 | 988 | 14.0 | 110 | F + B | 80 | 80 | 81 | 115.5 | 3 |
| C9 | 789 | 23.0 | 115 | F + B | 82 | *73 | 80 | 148.5 | 3 |
| C10 | 807 | 23.5 | 119 | F + B | 81 | 80 | *79 | 191.5 | 3 |
| C11 | 803 | 23.0 | 117 | F + B | 85 | 83 | *79 | 168.0 | 3 |

Note
F: ferrite,
B: bainite

JIS No. 5 test pieces were extracted from the hot rolled steel plates thus obtained and were subjected to a tensile test, a bore expansion test, and observation of structure. For the bore expansion test, the bore, formed by punching, having an initial bore diameter ($d_o$: 10 mm), was expanded by a 60-degree conical punch to determine the bore diameter (d) at which cracking on a level, which had passed through the plate thickness, occurred. This bore diameter (d) was used to determine and evaluate the bore expansion value (λ value)=$(d-d_0)/d_0\times100$. The results are shown in Table C2.

All of Nos. C1 to C11 are examples of the present invention wherein all the chemical composition, the finishing temperature, the air cooling start temperature, and the coiling temperature fall within the scope of the present invention and, at the same time, the value calculated by the formula, that is, $(917-480[C\ \%]+100[Si\ \%]-100[Mn\ \%])-(790\times([Ti\ \%]+[Nb\ \%]/2)^{0.05})$, was between 115 and 235. All of these plates were high strength hot rolled steel plates having a high λ value and a high level of elongation, that is, possessing excellent bore expandability and ductility.

In the case of hot rolling using a steel having a chemical composition of No. C1 under conditions of finishing temperature 920° C., air cooling start temperature 630° C., and coiling temperature 450° C., due to the air cooling start temperature below the air cooling start temperature range specified in the present invention, pearlite was formed in the structure, and the proportion of ferrite was as low as 75%. Consequently, the elongation was 21%, and the λ value was 95%, indicating that the balance between the bore expandability and the ductility was poor. Likewise, in the case of hot rolling using a steel having a chemical composition of No. C1 under conditions of finishing temperature 900° C., air cooling start temperature 700° C., and coiling temperature 330° C., due to the coiling temperature below the coiling temperature range specified in the present invention, martensite was formed in the structure, and the proportion of ferrite was as low as 65%. Consequently, the elongation was 19%, and the λ value was 83%, indicating that, here again, the balance between the bore expandability and the ductility was poor.

Figure 3:
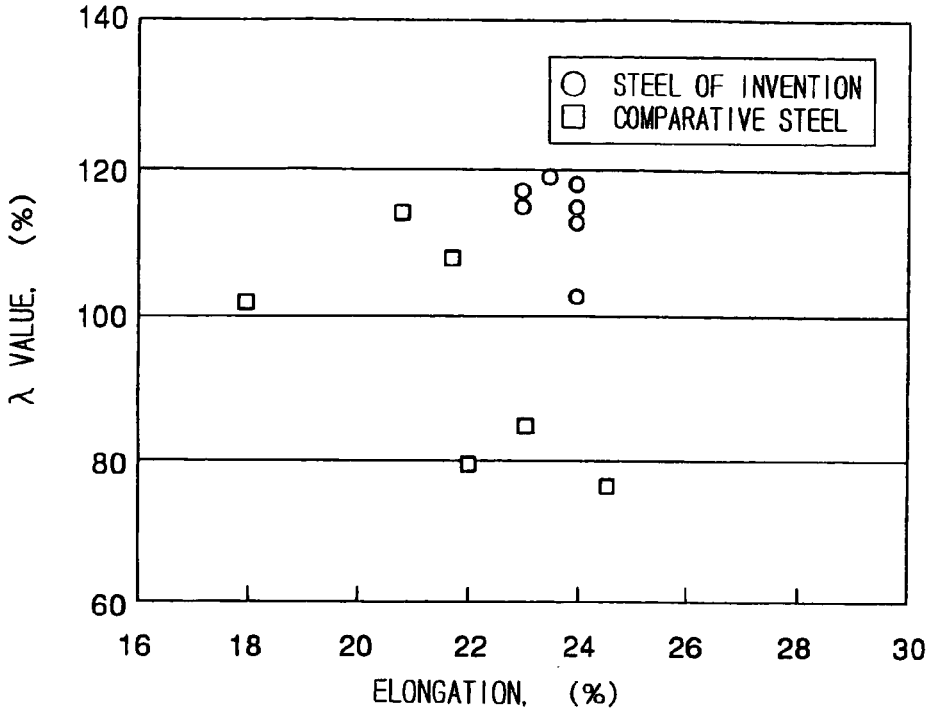
FIG. 3 is a scatter diagram showing a correlation between the elongation and the λ value in high strength hot rolled steel plates for steels according to the third aspect of the present invention and comparative steels.
Figure 4:
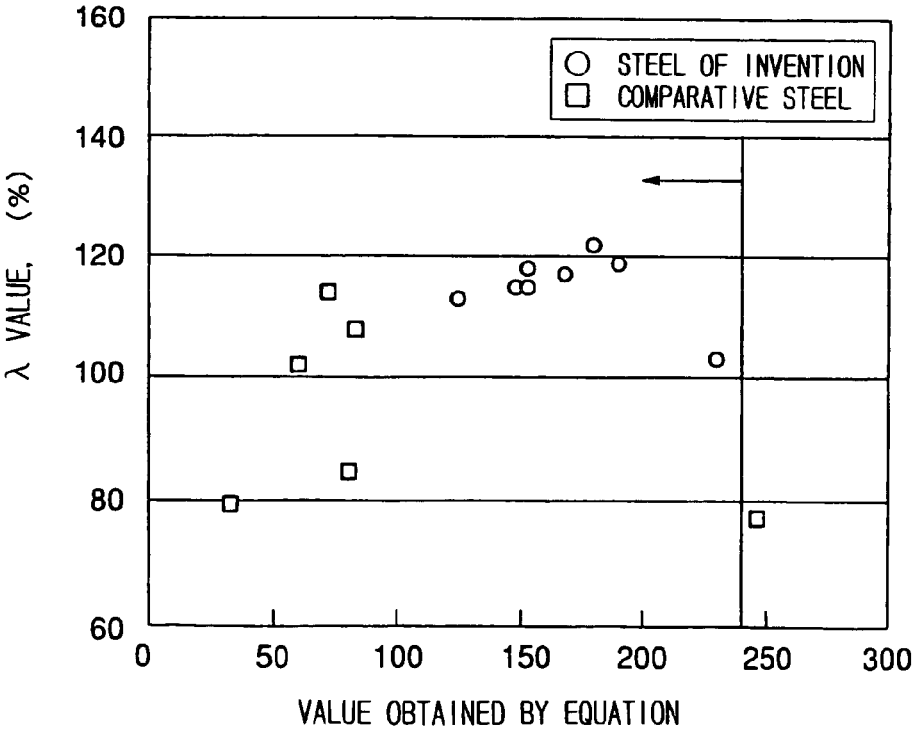
FIG. 4 is a scatter diagram showing a correlation between the value obtained by calculation formula and the λ value for steels according to the third aspect of the present invention and comparative steels.
Figure 5:
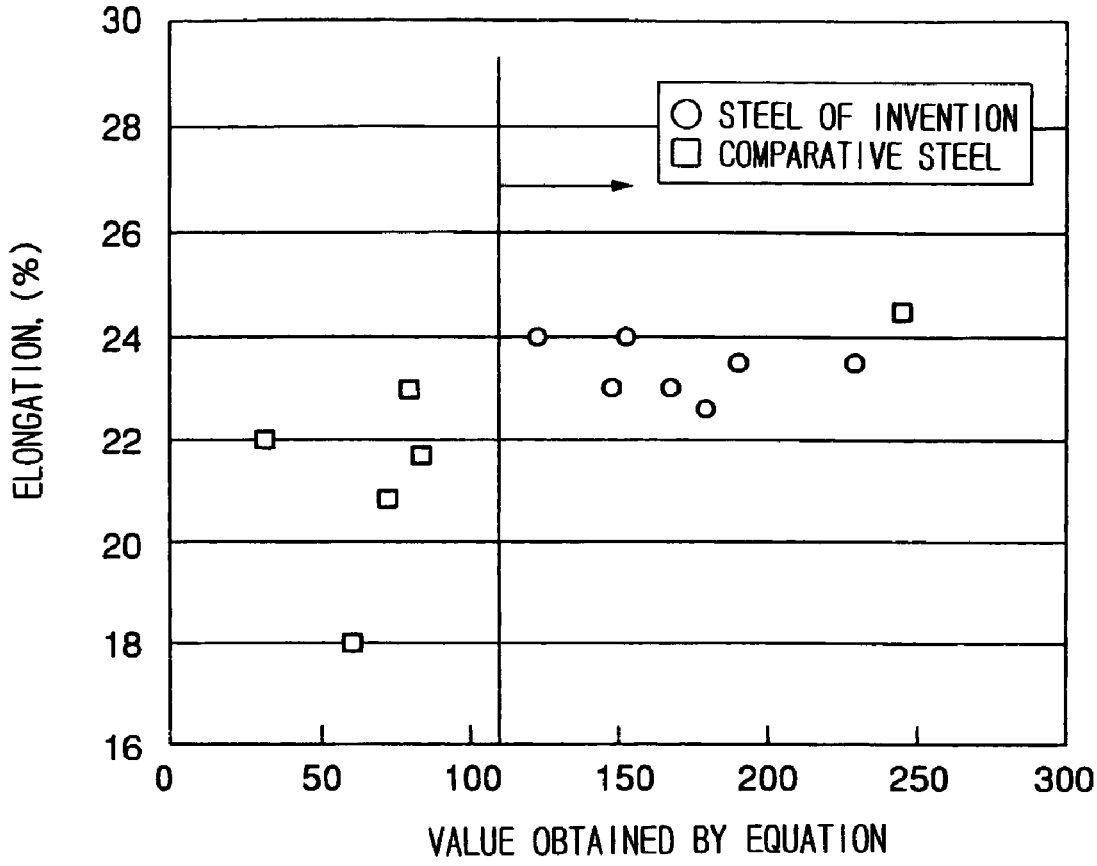
FIG. 5 is a scatter diagram showing a correlation between the value obtained by calculation formula and the elongation for steels according to the third aspect of the present invention and comparative steels.

FIG. 3 is a diagram showing the balance between the elongation and the λ value for high strength hot rolled steel plates having a tensile strength of 770 to 820 N/mm$^2$. As is apparent from FIG. 3, the steels of the present invention have better elongation and λ value than comparative steels (see Example E). As can be seen from FIGS. 4 and 5, these excellent properties of the steels according to the present invention could be achieved by bringing the value obtained by the calculation formula to one between 115 and 235. Steel plates shown in FIGS. 4 and 5 also are high-strength hot rolled steel plates having a tensile strength of 770 to 820 N/mm$^2$.

Example D

Steels having chemical compositions shown in Table D1 were produced by a melt process in a converter, followed by continuous casting to produce slabs. The slabs were rolled under hot rolling conditions shown in Table D1 and were then cooled to produce hot rolled steel plates having a thickness of 2.6 to 3.2 mm. In this example, the rate of rapid cooling was 40° C./sec., and the air cooling time was 10 sec.

TABLE D1

| No. | Chemical composition, mass % | | | | | | | | | Finishing temp., ° C. | Air cooling start temp., ° C. | Coiling temp., ° C. |
|---|---|---|---|---|---|---|---|---|---|---|---|---|
| | C | Si | Mn | P | S | Ti | Nb | Ca | REM | | | |
| D1 | 0.03 | 1.05 | 1.85 | 0.006 | 0.001 | 0.130 | — | — | — | 930 | 720 | 500 |
| D2 | 0.04 | 1.55 | 0.90 | 0.006 | 0.001 | 0.145 | — | — | — | 920 | 700 | 510 |
| D3 | 0.05 | 0.80 | 1.45 | 0.006 | 0.001 | 0.150 | — | — | — | 900 | 700 | 480 |
| D4 | 0.03 | 1.60 | 0.90 | 0.006 | 0.001 | 0.145 | — | — | — | 920 | 650 | 530 |
| D5 | 0.04 | 0.80 | 1.55 | 0.006 | 0.001 | 0.150 | — | 0.0030 | — | 910 | 670 | 520 |
| D6 | 0.06 | 1.15 | 1.70 | 0.006 | 0.001 | 0.155 | — | 0.0025 | — | 910 | 680 | 500 |
| D7 | 0.06 | 1.00 | 1.60 | 0.007 | 0.001 | 0.130 | 0.025 | 0.0250 | — | 900 | 700 | 480 |
| D8 | 0.03 | 0.95 | 1.65 | 0.007 | 0.001 | 0.140 | — | 0.0025 | — | 930 | 680 | 480 |
| D9 | 0.03 | 1.60 | 1.95 | 0.006 | 0.001 | 0.110 | — | — | — | 930 | 680 | 450 |
| D10 | 0.05 | 1.10 | 1.35 | 0.008 | 0.001 | 0.130 | 0.030 | — | — | 910 | 700 | 480 |
| D11 | 0.06 | 1.20 | 1.00 | 0.006 | 0.001 | 0.130 | 0.025 | — | — | 900 | 670 | 500 |
| D12 | 0.05 | 1.20 | 0.80 | 0.006 | 0.001 | 0.080 | — | — | — | 910 | 680 | 480 |
| D13 | 0.05 | 1.30 | 1.85 | 0.006 | 0.001 | 0.180 | 0.035 | 0.0025 | — | 910 | 700 | 500 |
| D14 | 0.04 | 1.40 | 2.00 | 0.007 | 0.001 | 0.165 | 0.035 | — | — | 920 | 700 | 520 |
| D15 | 0.05 | 1.35 | 1.90 | 0.006 | 0.001 | 0.175 | 0.030 | 0.0030 | — | 900 | 710 | 500 |
| D16 | 0.05 | 1.40 | 1.85 | 0.006 | 0.001 | 0.175 | 0.035 | 0.0030 | — | 900 | 670 | 480 |

TABLE D2

| No. | Tensile strength, $N/mm^2$ | Elongation, % | λ value, % | Structure | Proportion of ferrite, % | Proportion of ferrite having grain diameter of not less than 2 μm, % | Proportion of ds/dl ≧ 0.1, % | Value obtained by calculation formula | Aspect No. of invention |
|---|---|---|---|---|---|---|---|---|---|
| D1 | 791 | 22.0 | 105 | F + B | 84 | 80 | *78 | *109.2 | 2 |
| D2 | 781 | 22.5 | 108 | F + B | 82 | 80 | *77 | *245.5 | 2 |
| D3 | 783 | 22.0 | 110 | F + B | 84 | 81 | *77 | *109.5 | 2 |
| D4 | 780 | 22.5 | 113 | F + B | 83 | *75 | 82 | *255.3 | 1 |
| D5 | 787 | 22.0 | 111 | F + B | 82 | *76 | 81 | *104.3 | 1 |
| D6 | 845 | 17.5 | 115 | F + B | 84 | 82 | 81 | *113.5 | 4 |
| D7 | 840 | 18.5 | 118 | F + B | 83 | 81 | 80 | *111.5 | 4 |
| D8 | 784 | 23.5 | 120 | F + B | 86 | 83 | 83 | *106.6 | 4 |
| D9 | 803 | 24.5 | 127 | F + B | 87 | 83 | 82 | 160.1 | 7 |
| D10 | 831 | 20.0 | 121 | F + B | 85 | 82 | 81 | 150.7 | 7 |
| D11 | 799 | 24.5 | 125 | F + B | 88 | 85 | 84 | 191.5 | 7 |
| D12 | 691 | 26.5 | 135 | F + B | 85 | 83 | 82 | *236.7 | 4 |
| D13 | 994 | 13.0 | 101 | F + B | 82 | 80 | *78 | *109.5 | 2 |
| D14 | 982 | 13.5 | 99 | F + B | 80 | *75 | 82 | *112.2 | 1 |
| D15 | 981 | 14.5 | 107 | F + B | 84 | 82 | 81 | *110.9 | 4 |
| D16 | 992 | 15.0 | 113 | F + B | 86 | 83 | 82 | 120.5 | 7 |

Note
F: ferrite,
B: bainite

JIS No. 5 test pieces were extracted from the hot rolled steel plates thus obtained and were subjected to a tensile test, a bore expansion test, and observation of structure. For the bore expansion test, the bore, formed by punching, having an initial bore diameter ($d_o$: 10 mm), was expanded by a 60-degree conical punch to determine the bore diameter (d) at which cracking on a level, which had passed through the plate thickness, occurred. This bore diameter (d) was used to determine and evaluate the bore expansion value (λ value)=$(d-d_0)/d_0\times100$. The results are shown in Table D2.

Example E (Comparative Example)

Steels having chemical compositions shown in Table E1 were produced by a melt process in a converter, followed by continuous casting to produce slabs. The slabs were rolled under hot rolling conditions shown in Table El and were then cooled to produce hot rolled steel plates having a thickness of 2.6 to 3.2 mm. In this example, the rate of rapid cooling was 40° C./sec., and the air cooling time was 10 sec.

As is apparent from Table E2, for Nos. E1 to E10, which are comparative examples and do not satisfy requirements specified in the present invention, the balance among the strength, the bore expandability, and the ductility was poor.

As described above, according to the present invention, high strength hot rolled steel plates, which have a combination of high strength, i.e., a tensile strength of not less than 690 N/mm$^2$, with good bore expandability and ductility, can be provided in a cost-effective manner. Therefore, the high strength hot rolled steel plates of the present invention are suitable as high strength hot rolled steel plates having high workability. Further, the high strength hot rolled steel plates of the present invention can realize a reduction in weight of car bodies, one-piece molding of components, and the rationalization of a working process and, at the same time, can realize improved fuel consumption and reduced production cost and thus are highly valuable from the viewpoint of industry.

TABLE E1

| | Chemical composition, mass % | | | | | | | | | Finishing | Air cooling | Coiling |
|---|---|---|---|---|---|---|---|---|---|---|---|---|
| No. | C | Si | Mn | P | S | Ti | Nb | Ca | REM | temp., ° C. | start temp., ° C. | temp., ° C. |
| E1 | 0.03 | 0.51 | 1.45 | 0.071 | 0.001 | 0.246 | — | — | — | 880 | 660 | 550 |
| E2 | 0.03 | 0.51 | 1.48 | 0.010 | 0.001 | 0.151 | 0.013 | — | — | 870 | 680 | 450 |
| E3 | 0.04 | 0.70 | 2.20 | 0.013 | 0.002 | 0.130 | 0.020 | — | — | 850 | 650 | 500 |
| E4 | 0.04 | 0.99 | 1.98 | 0.019 | 0.001 | 0.120 | 0.030 | 0.0030 | — | 870 | 680 | 480 |
| E5 | 0.04 | 0.51 | 1.51 | 0.012 | 0.001 | 0.250 | — | — | — | 890 | 680 | 350 |
| E6 | 0.04 | 0.51 | 1.51 | 0.011 | 0.001 | 0.150 | 0.013 | — | — | 890 | 670 | 500 |
| E7 | 0.05 | 0.90 | 2.00 | 0.018 | 0.003 | 0.080 | 0.030 | — | — | 900 | 670 | 450 |
| E8 | 0.05 | 0.68 | 1.59 | 0.017 | 0.002 | 0.220 | — | — | — | 890 | 720 | 500 |
| E9 | 0.05 | 0.52 | 1.50 | 0.018 | 0.001 | 0.150 | 0.032 | 0.0030 | — | 920 | 700 | 520 |
| E10 | 0.06 | 0.76 | 1.53 | 0.019 | 0.005 | 0.250 | — | — | — | 920 | 680 | 500 |

TABLE E2

| No. | Tensile strength, N/mm$^2$ | Elongation, % | λ value, % | Structure | Proportion of ferrite, % | Proportion of ferrite having grain diameter of not less than 2 μm, % | Proportion of ds/dl ≧ 0.1, % | Value obtained by calculation formula | Classification |
|---|---|---|---|---|---|---|---|---|---|
| E1 | 843 | 15.0 | 105 | F + B | 82 | *44 | *38 | *72.1 | Comparative |
| E2 | 845 | 13.0 | 100 | F + B | 81 | *37 | *30 | *85.3 | Comparative |
| E3 | 819 | 22.0 | 80 | F + B | 78 | *76 | *73 | *31.8 | Comparative |
| E4 | 786 | 21.7 | 108 | F + B | 79 | *68 | *67 | *84.1 | Comparative |
| E5 | 868 | 13.0 | 110 | F + B | 78 | *32 | *28 | *77.8 | Comparative |
| E6 | 805 | 18.0 | 102 | F + B | 79 | *39 | *36 | *60.7 | Comparative |
| E7 | 803 | 23.0 | 85 | F + B | 79 | *77 | *75 | *80.7 | Comparative |
| E8 | 825 | 18.0 | 162 | F + B | 80 | *57 | *52 | *69.6 | Comparative |
| E9 | 802 | 20.8 | 114 | F + B | 80 | *59 | *60 | *72.8 | Comparative |
| E10 | 832 | 17.0 | 145 | F + B | 83 | *46 | *42 | *74.1 | Comparative |

Note
F: ferrite,
B: bainite

JIS No. 5 test pieces were extracted from the hot rolled steel plates thus obtained and were subjected to a tensile test, a bore expansion test, and observation of structure. For the bore expansion test, the bore, formed by punching, having an initial bore diameter ($d_0$: 10 mm), was expanded by a 60-degree conical punch to determine the bore diameter (d) at which cracking on a level, which had passed through the plate thickness, occurred. This bore diameter (d) was used to determine and evaluate the bore expansion value (λ value)=$(d-d_0)/d_0\times100$. The results are shown in Table E2.

The invention claimed is:

1. A high strength hot rolled steel plate having excellent bore expandability and ductility, comprising a steel comprising, by mass, 0.01 to 0.08% of carbon; 0.90 to 1.50% of silicon; 0.50 to 2.50% of manganese; phosphorus ≦0.03%; sulfur ≦0.005%; 0.05 to 0.20% of titanium; and 0.01 to 0.04% of niobium; and the balance consisting of iron and unavoidable impurities, wherein the contents of carbon (C), silicon (Si), manganese (Mn), titanium (Ti), and niobium (Nb) satisfy a requirement represented by formula $$115\leqq(917-480[C\ \%]+100[Si\ \%]-100[Mn\ \%])-(790\times([Ti\ \%]+[Nb\ \%]/2)^{0.05})\leqq235,$$

and wherein not less than 80% of all grains are accounted for by grains having a ratio (ds/dl) of minor axis (ds) to major axis (dl) of not less than 0.1, said steel plate consisting of a ferrite-bainite duplex steel structure consisting of not less than 80% of ferrite and the balance bainite, said steel plate having a strength of not less than 770 $N/mm^2$.

2. The high strength hot rolled steel plate of claim 1, having a bore expansion of greater than 100%.

3. The high strength hot rolled steel plate of claim 1, having a bore expansion value of 103% or higher.

4. A high strength hot rolled steel plate having excellent bore expandability and ductility, comprising, by mass, 0.01 to 0.08% of carbon; 0.90 to 1.50% of silicon; 0.50 to 2.50% of manganese; phosphorus ≦0.03%; sulfur ≦0.005%; 0.05 to 0.20% of titanium; and 0.01 to 0.04% of niobium; and the balance consisting of iron and unavoidable impurities, wherein the contents of carbon (C), silicon (Si), manganese (Mn), titanium (Ti), and niobium (Nb) satisfy a requirement represented by formula $$115 \leqq (917-480[C\ \%]+100[Si\ \%]-100[Mn\ \%])-(790\times([Ti\ \%]+[Nb\ \%]/2)^{0.05}) \leqq 235,$$

and wherein said steel plate has a ferrite-bainite duplex steel structure, in which the proportion of ferrite having a grain diameter of not less than 2 μm is not less than 80%, said steel plate having a strength of not less than 770 $N/mm^2$, having a bore expansion of greater than 100%.

5. The high strength hot rolled steel plate of claim 4, having a bore expansion value of 103% or higher.

6. A high strength hot rolled steel plate having excellent bore expandability and ductility, comprising a steel comprising, by mass, 0.01 to 0.08% of carbon; 0.90 to 1.50% of silicon; 0.50 to 2.50% of manganese; phosphorus ≦0.03%; sulfur ≦0.005%; 0.05 to 0.20% of titanium; and 0.01 to 0.04% of niobium; and the balance consisting of iron and unavoidable impurities, the contents of carbon (C), silicon (Si), manganese (Mn), titanium (Ti), and niobium (Nb) satisfying a requirement represented by formula $$115 \leqq (917-480[C\ \%]+100[Si\ \%]-100[Mn\ \%])-(790\times([Ti\ \%]+[Nb\ \%]/2)^{0.05}) \leqq 235,$$

said steel plate having a steel structure comprising not less than 80% of ferrite and the balance bainite, said steel plate having a strength of not less than 770 $N/mm^2$, having a bore expansion of greater than 100%.

7. The high strength hot rolled steel plate of claim 6, having a bore expansion value of 103% or higher.

8. A process for producing the high strength hot rolled steel plate having excellent bore expandability and ductility according to any one of claims 1, 4, or 6, said process comprising the steps of:

subjecting the steel having said chemical composition to hot rolling in such a manner that the rolling termination temperature is $Ar_3$ transformation temperature to 950° C.;

subsequently cooling the hot rolled steel plate to 650 to 800° C. at a cooling rate of not less than 20° C./sec.;

then air-cooling the steel plate for 2 to 15 sec.;

further cooling the steel plate to 350 to 600° C. at a cooling rate of not less than 20° C./sec.; and coiling the steel plate.

9. The high strength hot rolled steel plate having excellent bore expandability and ductility according to any one of claims 1, 4, or 6, which further comprises 0.0005 to 0.01% of at least one member selected from calcium and rare earth elements (REMs).

10. A process for producing the high strength hot rolled steel plate having excellent bore expandability and ductility according to claim 9, said process comprising the steps of:

subjecting the steel having said chemical composition to hot rolling in such a manner that the rolling termination temperature is $Ar_3$ transformation temperature to 950° C.;

subsequently cooling the hot rolled steel plate to 650 to 800° C. at a cooling rate of not less than 20° C./sec.;

then air-cooling the steel plate for 2 to 15 sec.;

further cooling the steel plate to 350 to 600° C. at a cooling rate of not less than 20° C./sec.; and coiling the steel plate.

* * * * *